US007997348B2

(12) United States Patent
Hosfield et al.

(10) Patent No.: US 7,997,348 B2
(45) Date of Patent: Aug. 16, 2011

(54) FOAM PROPORTIONING SYSTEM WITH LOW-END CONTROLLER

(75) Inventors: Robert L. Hosfield, Centerville, MN (US); Robert S. Horeck, Fridley, MN (US); Lawrence C. Arvidson, Andover, MN (US)

(73) Assignee: Sta-Rite Industries, LLC, Delavan, WI (US)

( * ) Notice: Subject to any disclaimer, the term of this patent is extended or adjusted under 35 U.S.C. 154(b) by 192 days.

(21) Appl. No.: 12/348,838

(22) Filed: Jan. 5, 2009

(65) Prior Publication Data

US 2009/0200045 A1 Aug. 13, 2009

Related U.S. Application Data

(60) Provisional application No. 61/009,864, filed on Jan. 3, 2008.

(51) Int. Cl.

| | |
|---|---|
| ***A62C 35/00*** | (2006.01) |
| ***A62C 5/02*** | (2006.01) |
| ***B05B 7/32*** | (2006.01) |
| ***B05B 7/28*** | (2006.01) |
| *A62C 27/00* | (2006.01) |

(52) U.S. Cl. ..... 169/14; 169/15; 169/16; 169/24; 239/124; 239/417.5

(58) Field of Classification Search ..... 169/5, 13–16, 169/19, 20, 24, 44; 239/67–69, 124, 126, 239/127, 310, 407, 417.5; 417/43, 46
See application file for complete search history.

(56) References Cited

U.S. PATENT DOCUMENTS

| | | | | |
|---|---|---|---|---|
| 3,636,708 | A | | 1/1972 | Karman et al. |
| 4,037,664 | A | | 7/1977 | Gibson |
| 4,169,278 | A | | 9/1979 | Roehlich et al. |
| 4,436,487 | A | * | 3/1984 | Purvis et al. ..... 417/46 |
| 5,232,052 | A | | 8/1993 | Arvidson et al. |
| 5,284,174 | A | | 2/1994 | Norman |
| 5,291,951 | A | | 3/1994 | Morand |
| 5,313,548 | A | | 5/1994 | Arvidson et al. |
| 5,398,765 | A | | 3/1995 | Worthington |
| 5,411,100 | A | | 5/1995 | Laskaris et al. |
| 5,494,112 | A | | 2/1996 | Arvidson et al. |
| RE35,362 | E | | 10/1996 | Arvidson et al. |
| 5,727,933 | A | | 3/1998 | Laskaris et al. |
| 5,764,463 | A | | 6/1998 | Arvidson et al. |
| 5,765,644 | A | | 6/1998 | Arvidson et al. |
| 5,816,328 | A | | 10/1998 | Mason et al. |
| 5,823,219 | A | | 10/1998 | Purvis et al. |
| 5,979,564 | A | | 11/1999 | Crabtree |
| 6,009,953 | A | | 1/2000 | Laskaris et al. |
| 6,085,586 | A | | 7/2000 | Arvidson et al. |
| 6,357,532 | B1 | | 3/2002 | Laskaris et al. |
| 6,454,540 | B1 | | 9/2002 | Terefinko et al. |
| 6,684,959 | B1 | | 2/2004 | Juidici et al. |
| 6,725,940 | B1 | | 4/2004 | Klein et al. |
| 6,733,004 | B2 | | 5/2004 | Crawley |

(Continued)

*Primary Examiner* — Darren W Gorman
(74) *Attorney, Agent, or Firm* — Quarles & Brady LLP

(57) ABSTRACT

Embodiments of the invention provide a foam proportioning system. The foam proportioning system can include a foam pump, at least one foam line, a divert, and at least one controller. The divert can direct a portion of a flow of a liquid foam concentrate downstream of the foam pump back through the foam pump. The controller, which can be in communication with the foam pump and the divert, can be configured to automatically maintain a minimum flow rate of the liquid foam concentrate through the foam pump.

10 Claims, 5 Drawing Sheets

U.S. PATENT DOCUMENTS

| | | | |
|---|---|---|---|
| 6,766,863 | B2 | 7/2004 | Arvidson et al. |
| 6,886,639 | B2 | 5/2005 | Arvidson et al. |
| 6,991,041 | B2 | 1/2006 | Laskaris et al. |
| 7,104,334 | B2 | 9/2006 | Thompson |
| 2005/0056435 | A1 | 3/2005 | Price et al. |
| 2005/0155776 | A1 | 7/2005 | Arvidson et al. |
| 2005/0183868 | A1 | 8/2005 | Taylor et al. |
| 2005/0222287 | A1 | 10/2005 | Roberts |
| 2007/0209807 | A1 | 9/2007 | Kruger et al. |
| 2007/0246230 | A1 | 10/2007 | Roberts |

* cited by examiner

FOAM PROPORTIONING SYSTEM WITH LOW-END CONTROLLER

RELATED APPLICATIONS

This application claims priority under 35 U.S.C. §119 to U.S. Provisional Patent Application No. 61/009,864 filed on Jan. 3, 2008, the entire contents of which is incorporated herein by reference.

BACKGROUND

Fire trucks, fire boats, military equipment, and stationary fire suppression systems are used to extinguish large industrial fires and will typically have water discharge lines coupled to a large capacity pump where the discharge lines vary in size from those feeding a water cannon capable of delivering over 1,000 gallons per minute to hand lines used in mopping-up operations that may deliver under 20 gallons per minute.

One of the most significant advancements in the field of fire fighting has come through the use of chemical foamants specifically formulated to augment the fire fighting ability of water. Foam injection systems have been designed to introduce liquid chemical foamant concentrate into a water stream being directed at a fire. A key advantage to using such foams is the dramatic reduction in the time required to extinguish fires. It has been demonstrated that Class A foam is from five to ten more times more effective as a fire suppressant than water alone. Utilizing foam, fires are extinguished faster and with substantially less water damage. The foam proves to be an effective barrier, preventing fire from spreading and protecting adjacent structures. As is set out in the U.S. Reissue Pat. No. 35,362 issued to Arvidson et al. ("the Arvidson Reissue patent"), the teachings of which are hereby incorporated by reference, it is desirable to have a foam injection system that is capable of automatically proportioning the foam additive in the concentration required for the specific fire-fighting problem. The Arvidson Reissue patent describes a system that is readily suited to residential fires, automobile fires, and those applications, where water flow rates tend to be below 1,000 gallons-per-minute.

SUMMARY

Some embodiments of the invention provide a foam proportioning system, which can inject a liquid foam concentrate into at least one discharge line. The foam proportioning system can include a foam pump, at least one foam line, a divert, and at least one controller. The foam pump can supply a flow of the liquid foam concentrate through the foam line, which can be in fluid communication with the discharge lines and the foam pump. The divert can include a recirculation line having a first end positioned downstream of the foam pump and a second end positioned upstream of the foam pump. The divert can direct a portion of the flow of the liquid foam concentrate downstream of the foam pump back through the foam pump. The controller, which can be in communication with the foam pump and the divert, can be configured to automatically maintain a minimum flow rate of the liquid foam concentrate through the foam pump.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1A:
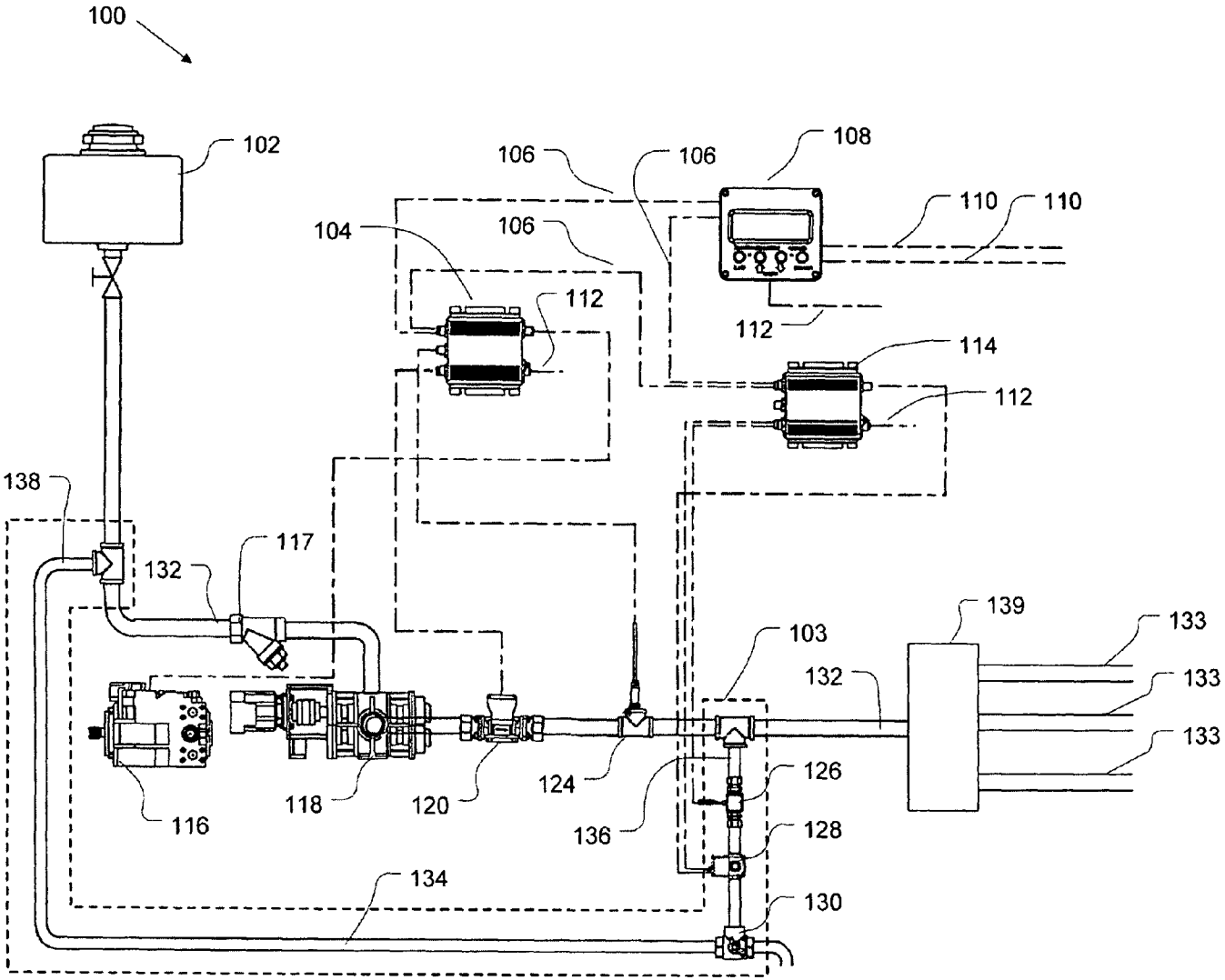
FIG. 1A is a schematic diagram of a foam proportioning system including a divert according to one embodiment of the invention.
Figure 1B:
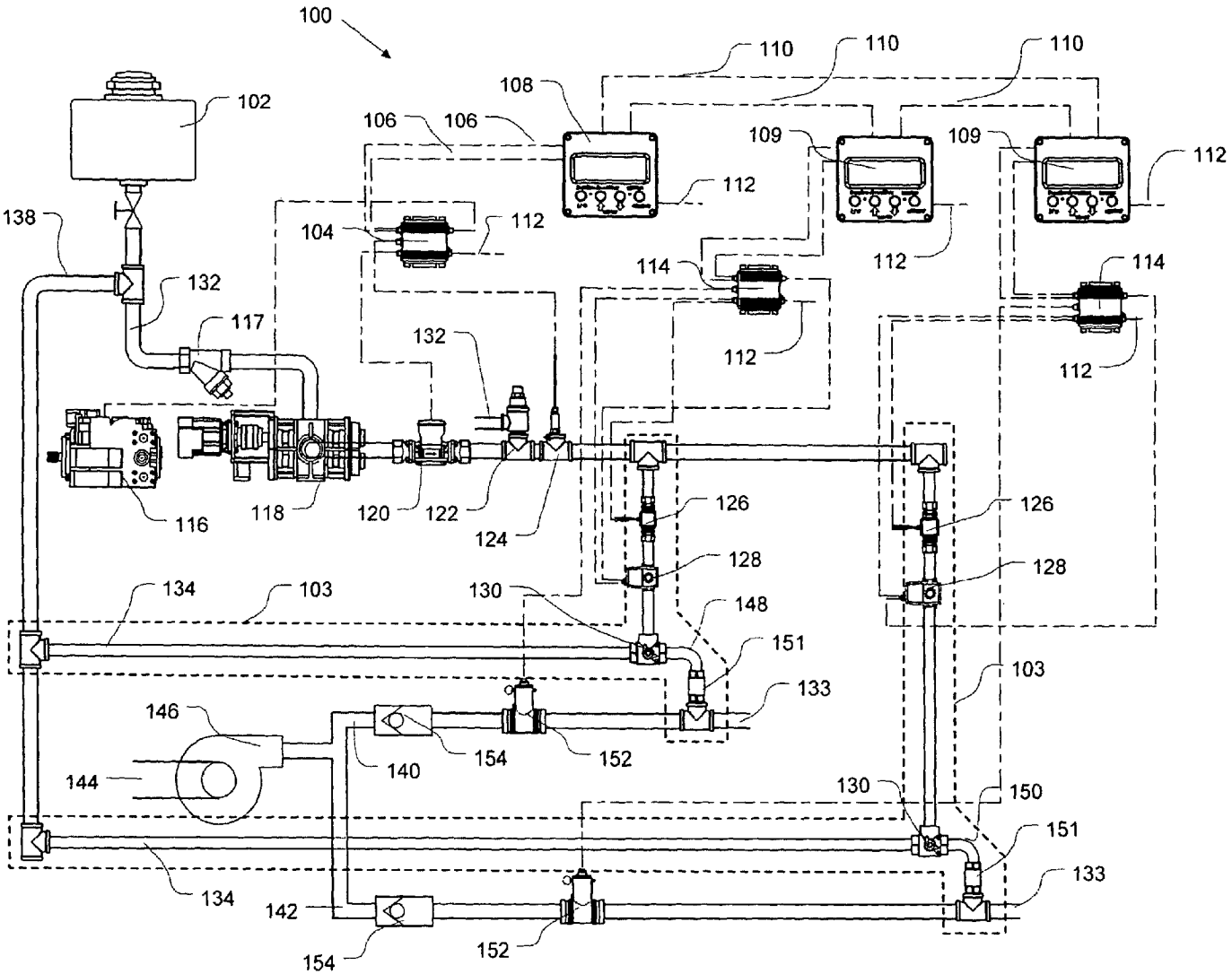
FIG. 1B is a schematic diagram of the foam proportioning system of FIG. 1A including multiple water discharge lines according to another embodiment of the invention.

FIG. 1 illustrates a foam proportioning system 100 according to one embodiment of the invention. The foam proportioning system 100 can be used with fire trucks, fire boats, military equipment, or stationary fire suppression systems installed in buildings. The foam proportioning system 100 can include a foam tank 102, a divert 103, a master driver 104, master/local bus cables 106, a display 108, system bus cables 110, one or more power sources 112, and a low-end line driver 114. In some embodiments, the low-end line driver 114 can be connected in parallel with the master driver 104. In some embodiments, a redundant communication line can be included between the low-end line driver 114 and the display 108. The foam proportioning system 100 can further include a hydraulic pump 116, a strainer 117, a foam pump 118, a master foam flow meter 120, a foam relief valve 122 (as shown in FIG. 1B), a foam line pressure transducer 124, and a low-end calibrate/inject valve 130.

The foam proportioning system 100 can include one or more foam lines 132 and a recirculation line 134. The pressure transducer 124 can be in communication with the master driver 104 and/or the low-end line driver 114 so that the foam pump 118 can shut down when a pressure in the foam line 132 is above a certain value. The recirculation line 134 can include a first end 136 positioned downstream of the foam pump 118 and a second end 138 positioned upstream of the foam pump 118. In some embodiments, the divert 103 can include a low-end foam flow meter 126 and a low-end control valve 128.

The foam proportioning system 100 can be used to inject metered quantities of a liquid foam concentrate (e.g., Class A or B foam concentrate) into one or more discharge lines 133 conveying a water stream to provide a predetermined concentration of the liquid foam concentrate in the water stream. The foam pump 118 can be configured to supply the flow of the liquid foam concentrate. The foam line 132 can be in fluid communication with the discharge line 133 and the foam pump 118. The foam line 132 can be configured to carry the flow of the liquid foam concentrate. In some embodiments, the foam line 132 can be connected to a manifold 139, in which incoming foam concentrate can be split to supply two or more discharge lines 133.

The divert 103 can be operable to direct a portion of the flow of the liquid foam concentrate downstream of the foam pump 118 back through the foam pump 118. A controller, for example in the form of the master driver 104 and/or the low-end line driver 114, can be in communication with the foam pump 118 and the divert 103. The controller 104, 114 can be configured to operate the foam pump 118 and the divert 103 to automatically maintain a minimum flow rate of the liquid foam concentrate ($Q_{min}$) through the foam pump 118. The minimum flow rate $Q_{min}$ through the foam pump 118 can be maintained in order to prevent the foam pump 118 from stalling. The minimum flow rate $Q_{min}$ can depend on the viscosity of the foam concentrate and can thus vary for different foam concentrates. The controller 104, 114 can also automatically maintain a proportioning rate between the flow of water and the flow of the foam concentrate into the water stream in order to establish a concentration of a water-foam solution. The controller 104, 114 can operate the divert 103 in response to the proportioning rate and the concentration of the water-foam solution.

In some embodiments, the low-end flow meter 126 of the divert 103 can be in communication with the controller 104, 114. The low-end flow meter 126 can monitor a flow rate of the liquid foam concentrate through the divert 103. In some embodiments, the low-end control valve 128 can also be in communication with the controller 104, 114. The low-end control valve 128 can be actuated in response to a signal from the controller 104, 114. The low-end control valve 128 can be closed when a foam demand is larger than the minimum flow rate $Q_{min}$. The low-end control valve 128 can be opened when a foam demand is less than the minimum flow rate $Q_{min}$ and can include one or more positions between a fully open position and a fully closed position. In one embodiment, the minimum flow rate $Q_{min}$ is about five gallons per minute. In another embodiment, the minimum flow rate $Q_{min}$ is about two gallons per minute.

In some embodiments, as shown in FIG. 1B, the foam proportioning system 100 can include two or more individual discharge lines 140, 142 that convey raw water from a water source 144 via a water pump 146 to corresponding discharge orifices (not shown). The foam proportioning system 100 can also include two or more foam lines 148, 150 (with corresponding injection check valves 151) coupled to convey the liquid foam concentrate from the foam pump 118 to at least one of the individual discharge lines 140, 142. In one embodiment, different proportioning rates of foam concentrate can be injected into the individual water lines 140, 142. The foam proportioning system 100 can include a line control display 109 and at least one controller 104, 114 for the water discharge lines 140, 142. The controller 104, 114 can be in communication with the foam pump 118 and the divert 103. The controller 104, 114 can be coupled to receive flow rate information from the discharge lines 140, 142 and the foam lines 148, 150. The controller 104, 114 can be configured to operate the foam pump 118 and the divert 103 to automatically maintain a minimum flow rate $Q_{min}$ of the liquid foam concentrate through the foam pump 118.

The controller 104, 114 can also automatically operate the foam pump 118 and the divert 103 to supply an appropriate amount of the liquid foam concentrate to the foam lines 148, 150 to maintain a predetermined concentration of the water-foam solution in at least one of the discharge lines 140, 142. The controller 104, 114 can automatically maintain a proportioning rate between the flow of water and the flow of liquid foam concentrate. The controller 104, 114 can operate the divert 103 in response to the proportioning rate and the predetermined concentration.

Figure 2A:
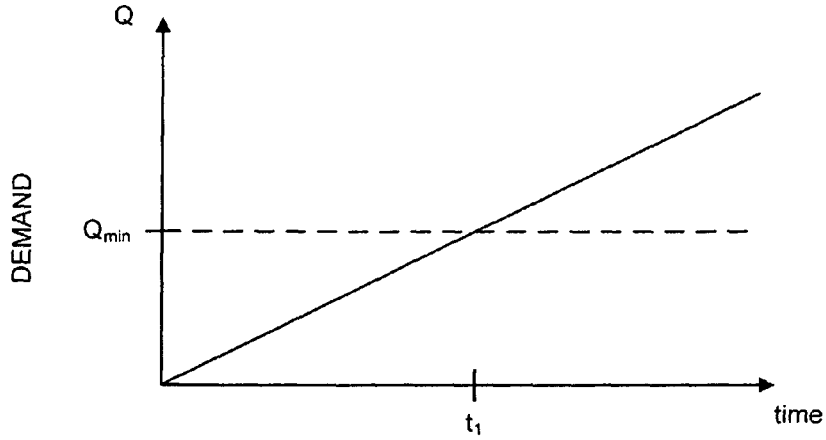
FIG. 2A is a graph of a demand of a liquid foam concentrate requested by the foam proportioning system according to one embodiment of the invention.
Figure 2B:
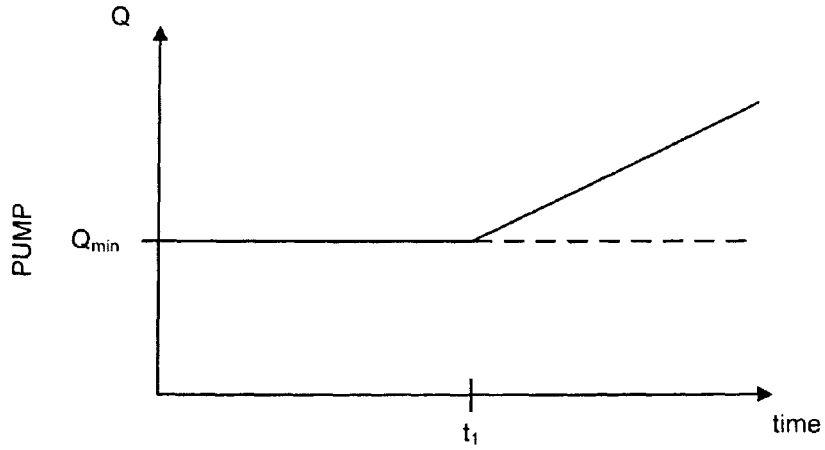
FIG. 2B is a graph of a liquid foam concentrate flow rate of a foam pump of the foam proportioning system according to one embodiment of the invention.
Figure 2C:
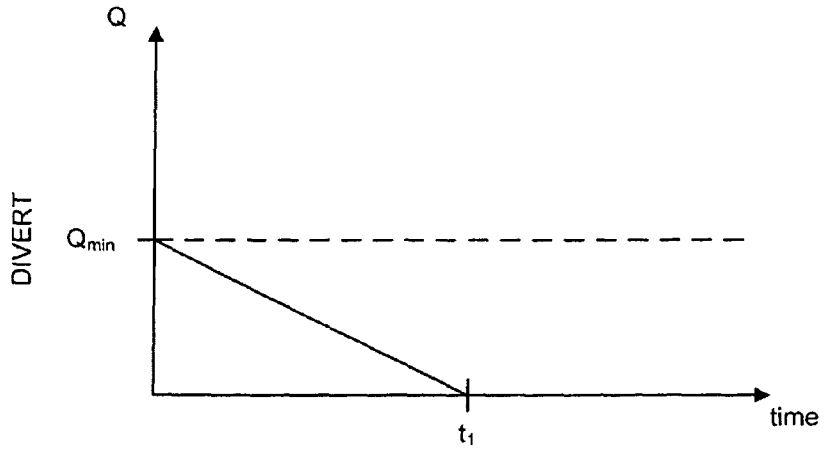
FIG. 2C is a graph of a flow rate through the divert of the foam proportioning system in order to fulfill the demand of FIG. 2A according to one embodiment of the invention.

FIG. 2A illustrates a linearly increasing flow rate of demanded liquid foam concentrate over time. At a time $t_1$, the minimum flow rate $Q_{min}$ of the foam pump 118 can be surpassed. As shown in FIG. 2B, the foam pump 118 can be operated at its minimum flow rate $Q_{min}$ up to the time $t_1$. After the time $t_1$, the foam pump 118 can be operated to fulfill the desired flow rate of the foam concentrate. Too much foam concentrate can compromise its effectiveness and can result in higher operating cost. As a result, the flow rate through the foam pump 118 in excess of the demanded flow rate (time $<t_1$) can be routed through the divert 103. FIG. 2C illustrates the flow rate of the foam concentrate through the divert 103. The flow rate of the foam concentrate through the divert 103 can substantially equal the difference of the flow rate through the foam pump 118 and the flow rate of the demanded liquid foam concentrate.

Some embodiments of the invention include a method of operating the foam proportioning system 100. The method can include sensing a water flow rate though the discharge lines 140, 142, for example using one or more discharge line flow meters 152 positioned downstream from discharge line check valves 154 (as shown in FIG. 1B). The controller 104, 114 can determine an appropriate foam flow rate to the discharge lines 140, 142 in order to automatically maintain the predetermined concentration of the liquid foam concentrate in the water stream. The controller 104, 114 can also automatically operate the foam pump 118 to supply a flow of the liquid foam concentrate. The foam pump 118 can be operable down to a minimum flow rate $Q_{min}$, where the foam pump 118 reaches its stall point. As the foam proportioning system 100 starts approaching the stall point of the foam pump 118 (for example as monitored by the foam flow meter 120), the controller 104, 114 can cause the low-end control valve 128 to open automatically in order to keep the flow rate through the foam pump 118 at a safe level. In this manner, the opening of the low-end control valve 128 and the flow of the liquid foam concentrate through the divert 103 can be substantially seamless to the operator or user of the foam proportioning system 100, while maintaining a desired accuracy. In some embodiments, the low-end control valve 128 can be a variable ball valve. When the low-end control valve 128 is open, the divert 103 can route a portion of the flow of the liquid foam concentrate back through an inlet of the foam pump 118 when the appropriate foam flow rate is less than the minimum flow rate of the foam pump 118.

In some embodiments, the method includes sensing a flow rate through the foam pump 118, for example using the foam flow meter 120. The method can include sensing a diverted flow rate of the portion of the flow of the liquid foam diverted back to the inlet of the foam pump 118, for example using the low-end foam flow meter 126. The method can also include sensing foam line flow rates into at least one of the discharge lines 140, 142, for example using the discharge line water flow meter 152. The controller 104, 114 can adjust the operation of the foam pump 118 and the diversion of the liquid foam concentration to maintain the minimum flow rate $Q_{min}$ through the foam pump 118 and the appropriate foam flow rate to the water discharge lines 140, 142. The divert 103 can route a portion of the flow of the liquid foam concentrate back to an inlet of the foam pump 118 only when the appropriate foam flow rate is less than the minimum flow rate $Q_{min}$. The controller 104, 114 can compute an appropriate foam flow rate based on the sensed water flow rates and a concentration of the water-foam solution selected by a user. The controller 104, 114 can increase the diverted portion of the flow of the liquid foam concentrate in response to a decrease in the computed foam flow rate. The controller 104, 114 can also decrease the diverted portion of the flow of the liquid foam concentrate in response to an increase in the computed foam flow rate. In one embodiment, to increase the foam flow rate being injected into the water stream, the controller 104, 114 can first decrease the portion that is being directed through the divert 103 before the foam pump 118 can be operated at a higher speed. As a result, the foam pump 118 can run at slower speeds in certain scenarios, which can reduce wear on the foam pump 118.

The low-end line driver 114 can provide information to the master driver 104 so that the master driver 104 can store the total foam demand from the multiple water discharge lines 140, 142 and can control the foam pump 118 and the low-end control valve 128 accordingly. When the divert 103 opens, the low-end line driver 114 can send a signal to the master driver 104.

Figure 3A:
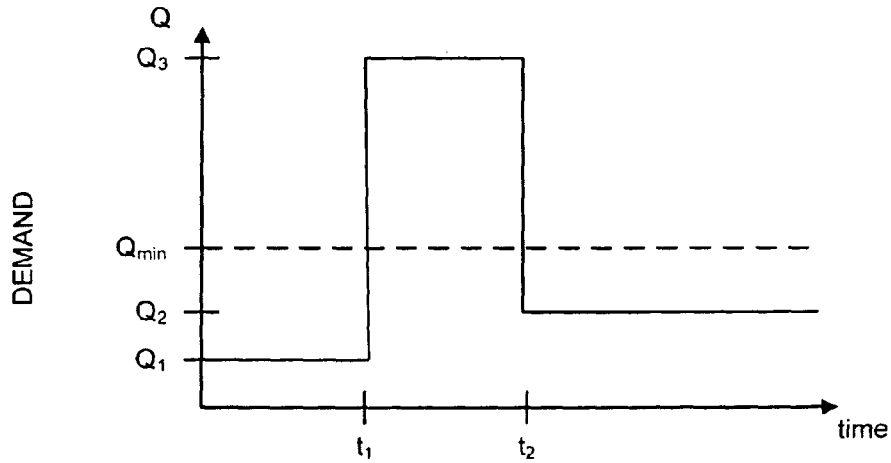
FIG. 3A is a graph of a varying demand of the liquid foam concentrate requested by the foam proportioning system according to one embodiment of the invention.
Figure 3B:
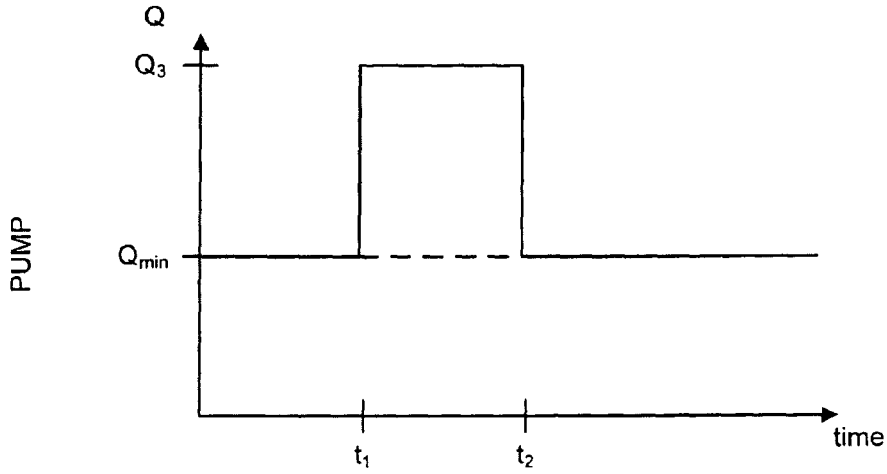
FIG. 3B is a graph of the flow rate of the foam pump resulting from the demand of FIG. 3A.
Figure 3C:
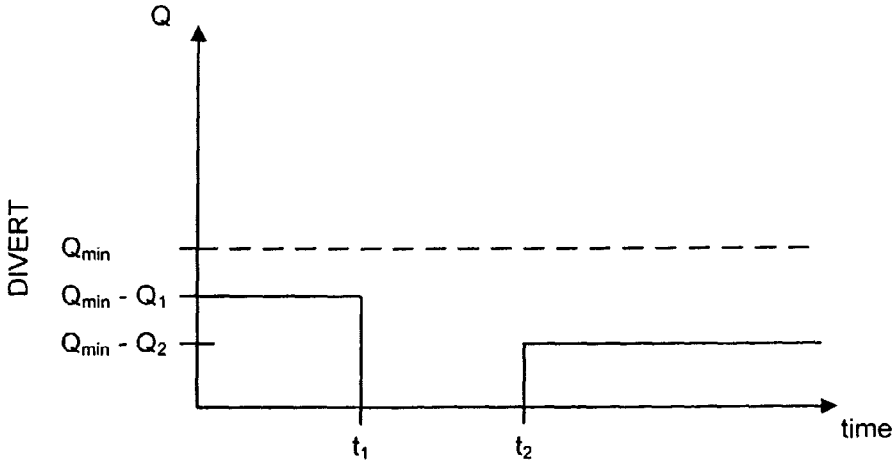
FIG. 3C is a graph of a flow rate through the divert of the foam proportioning system in order to fulfill the demand of FIG. 3A according to one embodiment of the invention.

FIGS. 3A-3C illustrate a demand in foam flow rate, a respective flow rate through the foam pump 118, and a flow rate through the divert 103. Up to a time $t_1$, a flow rate $Q_1$ can fulfill the desired fire fighting operation. Because the flow rate $Q_1$ is below the minimum flow rate $Q_{min}$ of the foam pump 118, the foam pump 118 can run at the minimum flow rate $Q_{min}$. The difference between the minimum flow rate $Q_{min}$ and the flow rate $Q_1$ can be directed through the divert 103. Between the time $t_1$ and a time $t_2$, the demand in foam flow rate can increase to a flow rate $Q_3$. An increase in flow rate can result from a higher foam concentration selected by a user, a change in water flow rate, activation of an additional discharge line, etc. Since the flow rate $Q_3$ is higher than the minimum flow rate $Q_{min}$, the foam pump 118 can be operated at a speed to fulfill the flow rate $Q_3$ and the divert 103 can be substantially closed. After the time $t_2$, the demand can decline to a flow rate $Q_2$. The decrease can result from a lower foam concentration selected by a user, a change in water flow rate, shutting down of a discharge line, etc. Because the flow rate $Q_2$ is below the minimum flow rate $Q_{min}$, the foam pump 118 can be operated at its minimum flow rate $Q_{min}$, while a difference between the minimum flow rate $Q_{min}$ and the flow rate $Q_2$ can be routed through the divert 103. Although abrupt changes are shown in FIGS. 3A through 3C, the changes in flow rate can be more gradual. Independent of a sudden changes or a more gradual change in flow rate, the divert 103 can be operated smoothly so that a user can be substantially unaware of whether or not the liquid foam concentrate is being routed through the divert 103.

Figure 4:
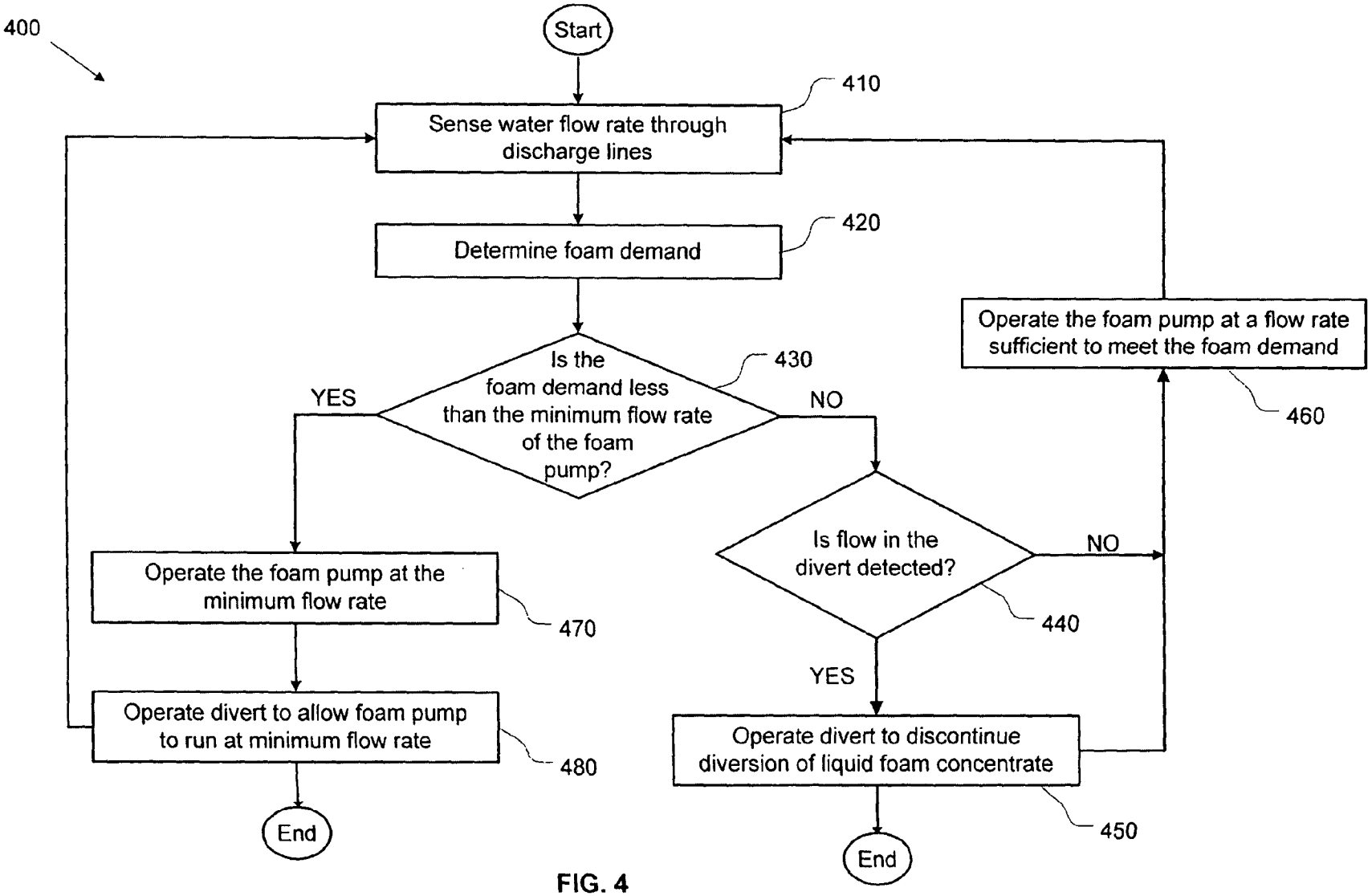
FIG. 4 is a flow chart of a method of operating the divert according to one embodiment of the invention.

FIG. 4 illustrates a method 400 of operating the foam proportioning system 100. A flow rate of water through the discharge lines 140,142 can be sensed (at 410). The corresponding foam flow rate can be computed based on a selected concentration rate (at 420). The computed foam flow rate can be compared with a minimum flow rate $Q_{min}$ of the foam pump 118 and the result can be evaluated (at 430). If the foam flow rate is higher than the minimum flow rate $Q_{min}$, the controller 104, 114 can determine if the liquid foam concentrate is directed through the divert 103 at 440. If the liquid foam concentrate is being directed through the divert 103, the flow of liquid foam concentrate can be discontinued (at 450). Thereafter or if there is no flow detected through the divert 103, the foam pump 118 can be operated with the required speed (at 460). If the computed flow rate is less than the minimum flow rate $Q_{min}$ (at 430), the foam pump 118 can be operated at the speed related to the minimum flow rate $Q_{min}$ (at 470) and the divert 103 can be operated to allow a respective flow rate being routed to a second end 138 upstream of the foam pump 118 (at 480).

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A foam proportioning system comprising:

a foam pump;

at least one foam line in fluid communication with a source of liquid foam concentrate, at least one discharge line, and the foam pump;

a divert having a recirculation line and a low-end control valve, the recirculation line having a first end positioned downstream of the foam pump and a second end positioned upstream of the foam pump, the divert operable to direct a portion of a flow of the liquid foam concentrate through the recirculation line; and at least one controller in communication with the foam pump and divert, the controller configured to automatically operate the foam pump and the divert to maintain a minimum flow rate of the liquid foam concentrate through the foam pump;

the low-end control valve being in communication with the at least one controller, operating in response to a signal from the at least one controller, and automatically opening when a foam demand is less than the minimum flow rate of the liquid foam concentrate through the foam pump.

2. The system of claim 1, wherein the low-end control valve is a ball valve.

3. The system of claim 1, wherein the at least one controller automatically maintains a proportioning rate between a flow of water in the at least one discharge line and the flow of liquid foam concentrate into the flow of water.

4. The system of claim 3, wherein the controller operates the divert in response to the proportioning rate.

5. The system of claim 1, wherein the divert includes a low-end flow meter in communication with the at least one controller, the low-end flow meter operable to monitor a flow rate of the liquid foam concentrate through the divert.

6. The system of claim 1, and further comprising a pressure transducer in the at least one foam line, the pressure transducer being in communication with the at least one controller.

7. The system of claim 6, wherein the at least one controller stops the foam pump when a signal from the pressure transducer indicates an overpressure in the at least one foam line.

8. The system of claim 1, and further comprising a manifold connecting the at least one foam line to a plurality of water lines.

9. The system of claim 1, wherein each foam line is in fluid communication with a corresponding discharge line.

10. The system of claim 9, wherein each foam line provides an individual proportioning rate to the corresponding discharge line.

* * * * *